United States Patent [19]

Cox

[11] Patent Number: 4,625,074

[45] Date of Patent: Nov. 25, 1986

[54] MASS TERMINABLE FLAT CABLE

[75] Inventor: Albert R. Cox, Centerville, Ind.

[73] Assignee: Cooper Industries, Inc., Houston, Tex.

[21] Appl. No.: 708,084

[22] Filed: Mar. 5, 1985

[51] Int. Cl.[4] ..... H01B 7/08

[52] U.S. Cl. ..... 174/117 F; 174/72 A

[58] Field of Search ..... 174/117 R, 117 F, 117 FF, 174/117 A, 72 A; 339/17 F, 176 MF

[56] References Cited

U.S. PATENT DOCUMENTS

| | | | |
|---|---|---|---|
| 2,851,515 | 9/1958 | Kolmorgen et al. | 174/117 |
| 3,082,292 | 3/1963 | Gore | 174/117 F |
| 3,168,617 | 2/1965 | Richter | 339/17 F |
| 3,733,428 | 5/1973 | Fry | 174/117 FX |
| 3,836,415 | 9/1974 | Hilderbrandt | 174/117 F X |
| 4,300,017 | 11/1981 | Segretto et al. | 174/117 FF X |
| 4,406,915 | 9/1983 | Lang | 174/117 FF X |
| 4,460,804 | 7/1984 | Svejkovsky | 174/117 FF X |
| 4,468,089 | 8/1984 | Brorein | 350/96.23 |

*Primary Examiner*—Arthur T. Grimley

*Assistant Examiner*—Morris H. Nimmo

*Attorney, Agent, or Firm*—Fitch, Even, Tabin & Flannery

[57] ABSTRACT

A flat cable for use with a mass termination connector having a plurality of regularly spaced terminal elements. The flat cable includes a laminated carrier film and a plurality of discrete conductors held in regularly spaced parallel relationship by the carrier film to match the terminal element spacing of the connector. Each conductor has an insulating jacket made of a thermoplastic material. The carrier film includes an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material. The jackets of the conductor are fused to the attachment layer, and the attachment layer is held by the stabilization layer. A method of manufacturing this cable is also disclosed.

13 Claims, 3 Drawing Figures

MASS TERMINABLE FLAT CABLE

The present invention relates to electrical wiring components and, more specifically, to a flat cable adapted for use with mass termination, insulation displacement connectors.

BACKGROUND OF THE INVENTION

Mass termination, insulation displacement connectors have come into increasing commercial prominence because of the significant savings in time and labor they offer compared to stripping and individually terminating each conductor using a crimp terminal. These connectors have an insulative housing body holding a number of regularly spaced terminal elements having slotted plates terminating in sharpened free ends extending beyond a surface of the body. The connectors also include covers having recesses in a facing surface for receiving the free ends of the plates. After the insulated conductors are aligned with their corresponding slotted plates, relative closing of the housing body and cover results in displacement of the insulation with the conductor cores contacting the metallic plates. For further information regarding the operation and structure of such mass termination connectors, reference may be made to U.S. Pat. Nos. 4,458,967 and 3,912,354.

The most efficient form of conductors for use with such connectors is the flat cable in which conductors, running parallel and spaced to match the spacing of the terminal elements in the connector, are held by a layer of insulation. The use of a flat cable avoids running the conductors one at a time and holding them in position for termination. The flat cable can be used for either a daisy chain connection (where the connector is applied intermediate the cable ends) or an end connection. The sharpened ends of the slotted plates pierce the web material between the conductors in the flat cable as the body and cover close so slitting of the cable between conductors is not required.

There are several methods for manufacturing flat cable. In one method, the insulation is extruded about parallel, coplanar conductors. In another, two layers of insulation are bonded together with the conductors held in parallel, coplanar relationship. Some of these methods require the use of large expensive manufacturing equipment. One simpler manufacturing method has been proposed wherein individual conductors, each having a thermoplastic jacket, are positioned on a layer of the same material as that used in the jackets. Upon raising the temperature to the melting point of the insulation, the jackets and layer will fuse, forming a flat cable. Unfortunately, the most commonly used insulating materials, such as polyvinyl chloride, have poor dimensional stability, particularly when the flat cable is subjected to varying temperatures.

A method of forming flat cable using conductor modules has also been suggested. In this method, pairs of conductors are formed into modules by applying a jacket of insulation about them. The modules are fed in edge-to-edge relationship between two webs of polyester material precoated with a hot-melt adhesive on their facing surfaces. This assembly is then subjected to heating and the application of pressure to form the final flat cable assembly. For additional information concerning this flat cable and its method of manufacture, reference may be made to U.S. Pat. No. 4,468,089.

SUMMARY OF THE INVENTION

Among the several aspects of the present invention may be noted the provision of an improved flat cable adapted for use with mass termination, insulation displacement connectors. The cable has greater strength, increased dimensional stability over a wide temperature range, lighter weight, and smaller finished cable thickness than conventional flat cables which employ a carrier film of the same insulating material as the jacket on the conductor cores. The cable of the present invention is reliable in use, has long service life and is simple and economical to manufacture. Other aspects and features of the present flat cable will be, in part, apparent and, in part, pointed out hereinafter in the following specification and in the accompanying claims and drawings.

Briefly, the flat cable of the present invention includes a laminated carrier film and a plurality of discrete conductors held in regularly spaced parallel relationship by the carrier film to match the terminal elements spacing of the connector. Each conductor has an insulative jacket made of a thermoplastic material. The carrier film includes an attachment layer of thermoplastic insulation having a melting temperature similar to that of the jacket material. The carrier film also includes a dimensional stabilization layer holding the attachment layer and made of insulative material having a melting temperature higher than those of the attachment layer and the jacket material and displaying dimensional stability at the melting temperatures of the attachment layer and the jacket material. The jackets of the conductors are fused to the attachment layer.

As a method of manufacturing a flat cable, the present invention includes several steps: (1) The jacketed conductors are positioned against the attachment layer so that the spacing of the conductors matches that of the terminal elements in the connector. (2) The temperatures of the conductors jackets and the attachment layer are raised until the jackets and the attachment layers fuses. (3) The conductors have their positions maintained on the attachment layer until the temperatures of the jackets and the attachment layer drop sufficiently so that the jackets are fixed.

BRIEF DESCRIPTION OF THE DRAWINGS

Corresponding reference numbers indicate corresponding components throughout the several views of the drawings.

DESCRIPTION OF THE PREFERRED EMBODIMENT

Figure 2:
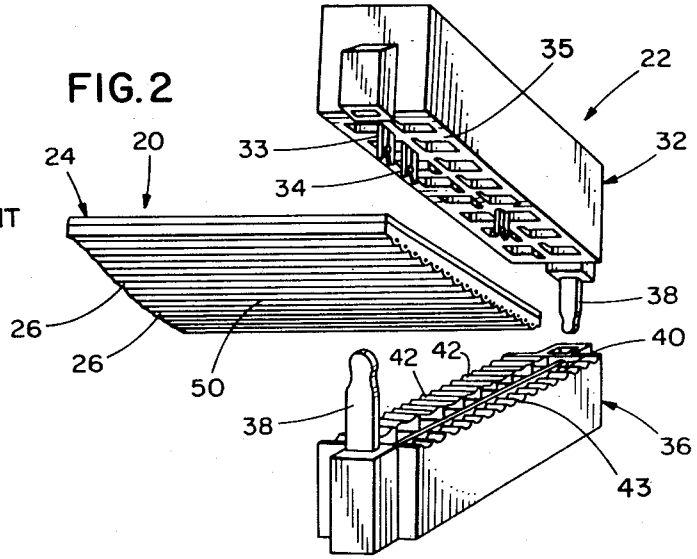
FIG. 2 is an exploded perspective view showing a mass termination insulation displacement connector usable with the cable of FIG. 1.

Referring now to the drawings, a flat cable of the present invention adapted for use with a mass termination, insulation displacement connector 22 (shown in FIG. 2), is generally indicated by reference numeral 20. The flat cable 20 includes a laminated carrier film 24 and a plurality of discrete conductors 26 held in regularly spaced, parallel relationship by the carrier film. Each conductor 26 includes a metallic, i.e., copper, core 28 and an insulating jacket 30 about the core. While the particular flat cable illustrated is intended for carrying electrical signals and has the cores on 0.050 inch centers, it will be appreciated that the flat cable 20 of the present invention can be made in larger sizes for use in supplying electrical power to various electrical components.

The mass termination connector 22 shown in FIG. 2 is of the high terminal density, signal conductor type and includes an insulative body 32 having two rows of terminal element cavities. A terminal element 33 is disposed in each cavity with elements in each row having a 0.100 inch pitch. Adjacent terminal elements in each row are staggered so that every other conductor 26 is terminated by elements in one row while the remaining conductors are terminated by the elements in the other row. Each terminal element includes a slotted plate 34 extending beyond a surface 35 of the body with the plate terminating in sharpened ends for piercing the web material of the flat cable between the conductors. The plate edges defining the slot function to displace the conductor jacket material so that by forcing a conductor 26 into a slotted plate 34, the conductor core 28 is engaged by the metallic plate to establish an electrical circuit. The connector 22 also includes a cover 36 held in alignment with the body 32 by means of pins 38. The cover, also formed of insulating material, includes a facing surface 40 having pockets 42 for locating the flat cable conductors 26 with respect to the terminal elements 33, and a recess 43 for receiving the free ends of the slotted plates 34. Thus after the flat cable 20 is positioned between the cover 36 and the body 32, relative closing of the two results in mass termination of the conductors 26 of the flat cable 20.

Figure 1:
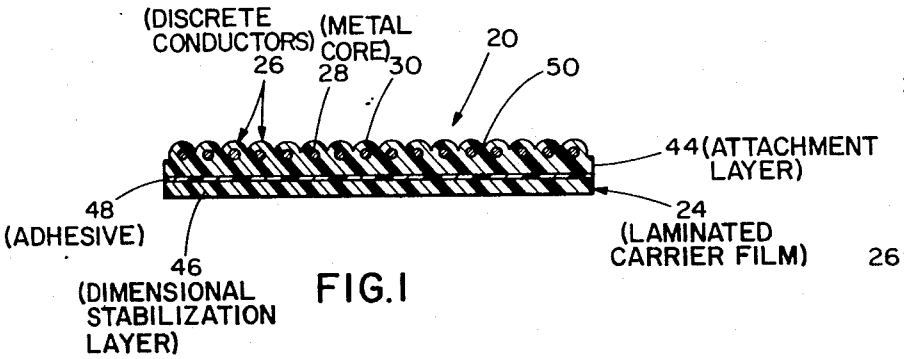
FIG. 1 is an end view of the mass terminable flat cable of the present invention.

Referring to FIG. 1, the carrier film 24 includes an attachment layer 44 of a thermoplastic insulation having a melting temperature similar to that of the jacket material 30, and a dimensional stabilization layer 46 made of an insulating material having a melting temperature higher than those of the attachment layer and the jacket material and displaying dimensional stability at the melting temperatures of the attachment layer and the jacket material. The jackets 30 of the conductors 26 are fused to the attachment layer 44 and the attachment layer is held by the stabilization layer 46 preferably by bonding them together with an adhesive 48, or the attachment layer and the stabilization layer may themselves be fused. Also preferably the attachment layer 44 and the conductor jackets 30 are made of the same insulating material. Among the several combinations of insulating materials are the following: polyvinyl chloride jackets and attachment layer with polyester stabilization layer; fluorinated ethylene-propylene jackets and attachment layer with tetrafluoroethylene stabilization layer; polyethylene jackets and attachment layer with polyester stabilization layer; and polypropylene jackets and attachment layer with polyester stabilization layer.

With respect to the first combination, polyester offers a greater strength to weight ratio than polyvinyl chloride. Also polyester has better dimensional stability over a wide range of thermal and environmental conditions. The other combinations offer similar characteristics. Thus the cable 20 can have greater strength, better temperature stability, smaller thickness and lighter weight than a conventional flat cable which uses a carrier layer of the same insulating material as the conductor jackets. Additionally, the polyester stabilization layer 46 serves a strain relief function when mass termination connectors including strain clips are employed. Upon tensioning of the flat cable between connectors, the polyester layer resists extension of the jackets and the metallic conductor cores.

It will also be appreciated that the flat cable 20 has a side 50 which is undulating, with the undulations formed by the individual jackets 30. These undulations are received by the pockets 42 in the connector cover 36 to properly locate the various cores 28 in alignment with their corresponding slotted plates 34. This is advantageous over a flat cable having flat sides because the connector does not have to be provided with alignment stops at the sides of the cover and/or body to position the flat cable in position for termination.

Figure 3:
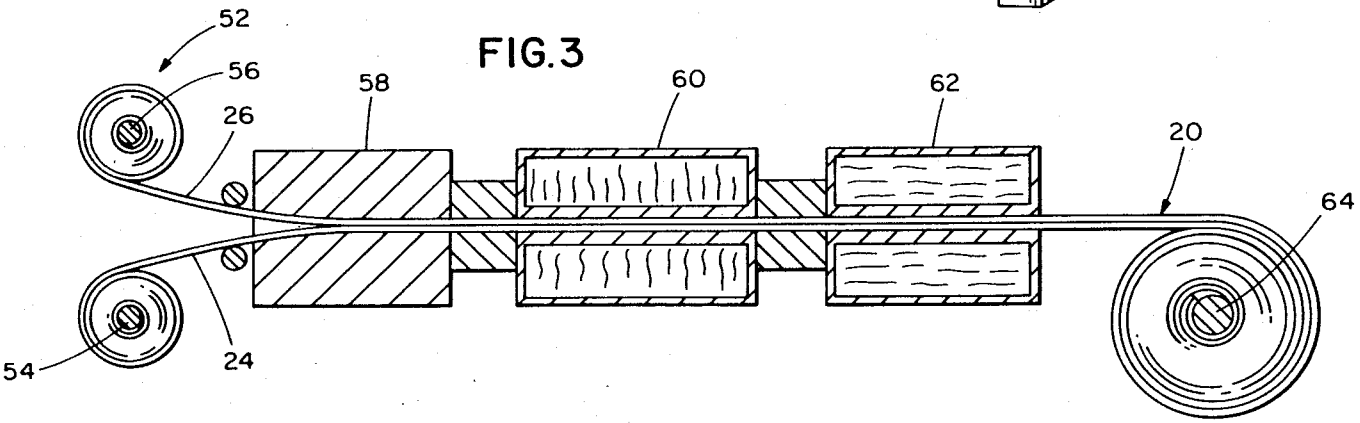
FIG. 3 is a simplified diagrammatic representation of a method of manufacturing the cable of FIG. 1.

As shown diagrammatically in FIG. 3, the flat cable 20 of the present invention is relatively simple to manufacture using a continuous process. At a feed station 52 are positioned a roll 54 of the carrier film 24 and a number of spools 56 of the conductors 26. The carrier film and the plurality of the conductors are received by a positioning die 58 which aligns the various conductors 26 in regularly spaced, parallel relationship on the attachment layer 44 of the carrier film. The die has conductor-receiving passageways which decrease in dimension from the die entrance side to its exit side so that upon exit of the cable components, the conductors are held firmly against the attachment layer. The film and conductors next pass through a heating zone 60 where the temperatures of the jacket material and the attachment layer are raised sufficiently that the conductors and attachment layer fuse. Next downstream is a cooling zone where another die 62 functions firmly to hold the conductors against the attachment layer until the jackets are fixed onto the attachment layer. Finally, the completed flat cable 20 is wound on a take up reel 64. The above description assumes that the formation of the carrier layer has been completed. The carrier layer 24 can also be formed as a preliminary operation in this manufacturing process by including an upstream station where the attachment layer and stabilization layer are bonded.

As a method of manufacturing a flat cable for use with a mass termination connector 22 having regularly spaced terminal elements 33, the present invention includes the following steps:

(1) The jacketed conductors 26 are positioned in parallel spaced relationship against the carrier film 24 so that the conductor engage the attachment layer 44 with the spacing between the conductors matching that of the terminal elements in the connector.

(2) The temperatures of the conductor jackets 30 and the attachment layer 44 are raised so that the jackets and the attachment layer fuse. However, the temperature of the stabilization layer 46 remains below its melting temperature.

(3) The positioning of the conductors is maintained until the temperatures of the jackets and the attachment layer drop sufficiently so that the jackets become fixed on the attachment layer.

It will be appreciated that the particular construction of the flat cable 20 allows the use of different insulating materials for the jackets 30 of the conductors in the same manufacturing process without requiring modification of expensive equipment components. This is because of the great flexibility offered by cable 20. If a particular insulation is required for the conductor jackets, only the attachment layer coating on the polyester film stabilization layer need by changed to match the jacket material used in the conductors 26.

While the flat cable is shown with the conductors running parallel throughout the length of the cable, the cable could alternatively have sections wherein adjacent conductors form twisted pairs with those sections spaced by other sections wherein the conductors run parallel to one another.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A flat cable for use with a mass termination connector having a plurality of regularly spaced terminal elements, said flat cable comprising:

a laminated carrier film; and a plurality of discrete conductors held in regularly spaced parallel relationship by said carrier film, each conductor having an insulative jacket made of a thermoplastic material, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer, said flat cable having a substantially flat side and an opposite undulating side with each undulation formed by one of the jacketed conductors.

2. A flat cable as set forth in claim 1 wherein the conductor jackets and the attachment layer are made of the same material.

3. A flat cable as set forth in claim 1 wherein the said attachment layer is formed of polyvinyl chloride.

4. A flat cable as set forth in claim 1 wherein said stabilization layer is made of polyester film.

5. A flat cable as set forth in claim 1 wherein said carrier film comprises an adhesive bonding said attachment layer to said stabilization layer.

6. A flat cable for use with a mass termination connector having a plurality of regularly spaced terminal elements, said flat cable comprising:

a laminated carrier film; and a plurality of discrete conductors held in regularly spaced parallel relationship by said carrier film, each conductor having an insulative jacket made of a thermoplastic material, said carrer film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer, said attachment layer being formed by polyvinyl chloride.

7. A flat cable as set forth in claim 6 wherein said stabilization layer is made of a polyester film.

8. A flat cable for use with a mass termination connector having a plurality of regularly spaced terminal elements, said flat cable comprising:

a laminated carrier film; and a plurality of discrete conductors held in regularly spaced parallel relationship by said carrier film, each conductor having an insulative jacket made of a thermoplastic material, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperature of the attachment layer and jacket material, the jackets of said conductors being fused to said attachment layer and said attachment layer being held by said stabilization layer, said attachment layer being formed of fluorinated ethylene-propylene.

9. A flat cable as set forth in claim 8 wherein said stabilization layer is made of a tetrafluoroethylene film.

10. A flat cable for use with a mass termination connector having a plurality of regularly spaced terminal elements, said flat cable comprising:

a laminated carrier film; and a plurality of discrete conductors held in regularly spaced parallel relationship by said carrier film, each conductor having an insulative jacket made of a thermoplastic material, said carrier film including an attachment layer of thermoplastic insulation having a melting temperature similar to that of the jacket material, and a dimensional stabilization layer made of an insulative material having a melting temperature higher than those of the attachement layer and the jacket material and displaying dimensional stability at the melting temperatures of the attachment layer and jacket material, the jackets of said conductors being fused to said attachment layer and said attachment layer being held by said stabilization layer, said attachment layer being formed of polyethylene.

11. A flat cable as set forth in claim 10 wherein said stabilizarion layer is made of a polyester film.

12. A flat cable for use with a mass termination connector having a plurality of regularly spaced terminal elements, said flat cable comprising:

a laminated carrier film; and a plurality of discrete conductors held in regularly spaced parallel relationship by said carrier film, each conductor having an insulative jacket made of a thermoplastic material, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer, said attachment layer being formed of polypropylene.

13. A flat cable as set forth in claim 12 wherein said stabilization is made of a polyester film.

* * * * *

UNITED STATES PATENT AND TRADEMARK OFFICE

CERTIFICATE OF CORRECTION

PATENT NO. : 4,625,074

DATED : November 25, 1986

INVENTOR(S) : Albert R. Cox

It is certified that error appears in the above-identified patent and that said Letters Patent is hereby corrected as shown below:

Column 2, line 40, change "fuses" to --fuse--.

Column 5, line 43, after "of" insert --a--.

Column 6, line 16, change "temperature" to --temperatures--.

Column 6, line 45, change "stabilizarion" to --stabilization--.

Signed and Sealed this

Twenty-eighth Day of April, 1987

*Attest:*

DONALD J. QUIGG

*Attesting Officer*

*Commissioner of Patents and Trademarks*